US005179828A

United States Patent [19]

Stahlecker

[11] Patent Number: 5,179,828

[45] Date of Patent: Jan. 19, 1993

[54] SPINNING MACHINE HAVING A DOFFING ARRANGEMENT

[75] Inventor: Fritz Stahlecker, Bad Überkingen, Fed. Rep. of Germany

[73] Assignee: One-half to Hans Stahlecker, Fed. Rep. of Germany

[21] Appl. No.: 618,082

[22] Filed: Nov. 21, 1990

[30] Foreign Application Priority Data

Nov. 22, 1989 [DE] Fed. Rep. of Germany ..... 3938679

[51] Int. Cl.[5] ..... D01H 1/20; D01H 15/00; D01H 13/18

[52] U.S. Cl. ..... 57/269; 57/80; 57/278; 57/333

[58] Field of Search ..... 57/261, 264, 269, 270–272, 57/278–279, 281, 332–333, 80–81, 253, 266, 276

[56] References Cited

U.S. PATENT DOCUMENTS 3,855,771 12/1974 Yoshizawa et al. ..... 57/269
4,833,874 5/1989 Stahlecker et al. ..... 57/261
4,964,268 10/1990 Stahlecker ..... 57/261
5,044,150 9/1991 Stahlecker ..... 57/328

FOREIGN PATENT DOCUMENTS 3634464 4/1988 Fed. Rep. of Germany .
3801965 7/1989 Fed. Rep. of Germany ..... 57/269
3817493 11/1989 Fed. Rep. of Germany ..... 57/261
3828323 2/1990 Fed. Rep. of Germany ..... 57/261

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

In a case of a spinning machine having a plurality of spinning positions and having a package spool changing arrangement or doffing arrangement which can be applied to the individual spinning positions, it is provided that the doffing arrangement comprises devices for the winding-off of the yarn wound onto a full X-package and for winding this yarn back onto a predetermined area of the X-package in parallel layers and/or layers disposed above one another.

22 Claims, 3 Drawing Sheets

SPINNING MACHINE HAVING A DOFFING ARRANGEMENT

BACKGROUND AND SUMMARY OF THE INVENTION

The invention relates to a spinning machine having a plurality of spinning positions and having a package spool changing arrangement or doffing arrangement which can be moved along the spinning machine. The doffing arrangement can be applied to the individual spinning positions and is equipped with devices for removing a full X-package out of a cradle of a spinning position and with devices for inserting an empty tube at the spinning position. Each spinning position is provided with devices for detecting a predetermined degree of fullness of the X-package and for interrupting the spinning operation of this spinning position.

In the case of spinning machines of the initially mentioned type, it is generally customary that, also when the spinning position is stopped, the yarn is wound onto the X-package while maintaining the cross-winding so that the yarn end may be situated at any arbitrary point of the X-package. The yarn end must then be found for a subsequent processing step of the X-package in which the yarn is again removed from the X-package. This operation may be connected with considerable difficulties, particularly if the circumference of the package is subjected to transport stress. These difficulties occur mainly in the case of fine yarns and particularly also in the case of X-packages wherein two yarns were wound onto the X-package as a double yarn. It will then frequently be difficult to grip the yarn ends of the two individual yarns simultaneously and in a sufficiently secure manner. In particular, it may happen during the transporting of the X-package that the ends of the two yarns separate from one another and will then be situated at different points on the X-package.

It is an object of the invention to develop a spinning machine of the initially mentioned type such that a later finding of the yarn end or yarn ends on the X-package is facilitated.

This object is achieved in that the doffing arrangement comprises devices for the winding-off of the yarn wound onto the full X-package and for winding this yarn back onto a predetermined area of the X-package in parallel layers and/or layers disposed above one another.

As a result of the inventive arrangement, it is achieved that the yarn end comes to be situated at a defined point of the X-package so that it can be picked up again relatively easily. Since the picking-up is normally carried out by means of a suction nozzle, this suction nozzle must only be aligned to the predetermined area of the X-package. This is advantageous particularly in the case of X-packages onto which a sensitive yarn was wound, for example, a double yarn formed from only prestrengthened individual yarns, where there is the danger that a strong suction pull of the suction device may damage the yarns.

In a further development of the invention, it is provided that each spinning position is equipped with devices for holding the yarn end formed during the interruption which are arranged at a distance from a cradle for the X-package. As a result, it is ensured that, also during the winding-off to be carried out by the doffing arrangement, the yarn end can be found very easily because it is held to be available at a point away from the X-package. This prevents that the yarn end, during the stopping, is pressed into the outer circumference of the X-package and will then be hard to find and to detach.

In a further development of the invention, it is provided that the devices for the holding have a suction device. In an advantageous manner, this suction device may then also be used to first store the yarn length wound off during the winding-off by means of the doffing arrangement and then release it during the rewinding which follows.

In another development of the invention, it is provided that each spinning position is equipped with devices for taking the yarn out of a cross-winding device which is part of the spinning position, in which case, these devices can be operated during the interruption of the spinning operation when a predetermined degree of fullness of the X-package is reached. This ensures that, after the interruption of the spinning operation, the yarn, on the one hand, is not subjected to stress by the cross-winding device while, on the other hand, it is also ensured that the cross-winding device is bypassed during the rewinding carried out by the doffing arrangement.

In a further development of the invention, it is provided that each spinning position, which is equipped with devices for spinning two individual yarns and for guiding the individual yarns together to form a double yarn, is provided with devices for strengthening the double yarn which can be operated during the interruption of the spinning operation when a predetermined degree of fullness of the X-package is reached. Thus it is achieved, particularly for X-packages with double yarns consisting of only prestrengthened individual yarns, that for the subsequent operation, particularly for a twisting, a uniform and relatively firm yarn end is available which is easier to grip and to be subjected to threading operations or the like.

In another development of the operation, it is provided that the doffing arrangement is equipped with devices for the strengthening of the yarn which, after being wound off, must again be wound up onto the X-package. Also this development may particularly advantageously be used during the producing of X-packages with double yarns consisting of only prestrengthened individual yarns. This strengthening may take place in that the two individual yarns are strengthened by means of swirling-together or winding-around or by adding a strengthening medium. In this case, an auxiliary yarn, particularly a filament yarn, may also be added which causes the strengthening. It is also possible to carry the strengthening out in such a manner that a spun or twisted auxiliary yarn which has a clearly higher strength is pieced to the yarn end and thus can be manipulated with the risk of yarn breakages being lower.

In a further development of the invention, it is provided that the doffing arrangement is equipped with devices for cutting into lengths the yarn which is to be wound back onto the X-package. This achieves, on the one hand, that a precisely determined length is wound up at the predetermined area while, on the other hand, a defined end of the yarn is produced; i.e., that, particularly in the case of a double yarn, the ends of the two individual yarns come to be situated at the same point and the individual yarns also have the same length.

Other objects, advantages and novel features of the present invention will become apparent from the following detailed description of the invention when considered in conjunction with the accompanying drawings.

DETAILED DESCRIPTION OF THE DRAWINGS

Figure 1:
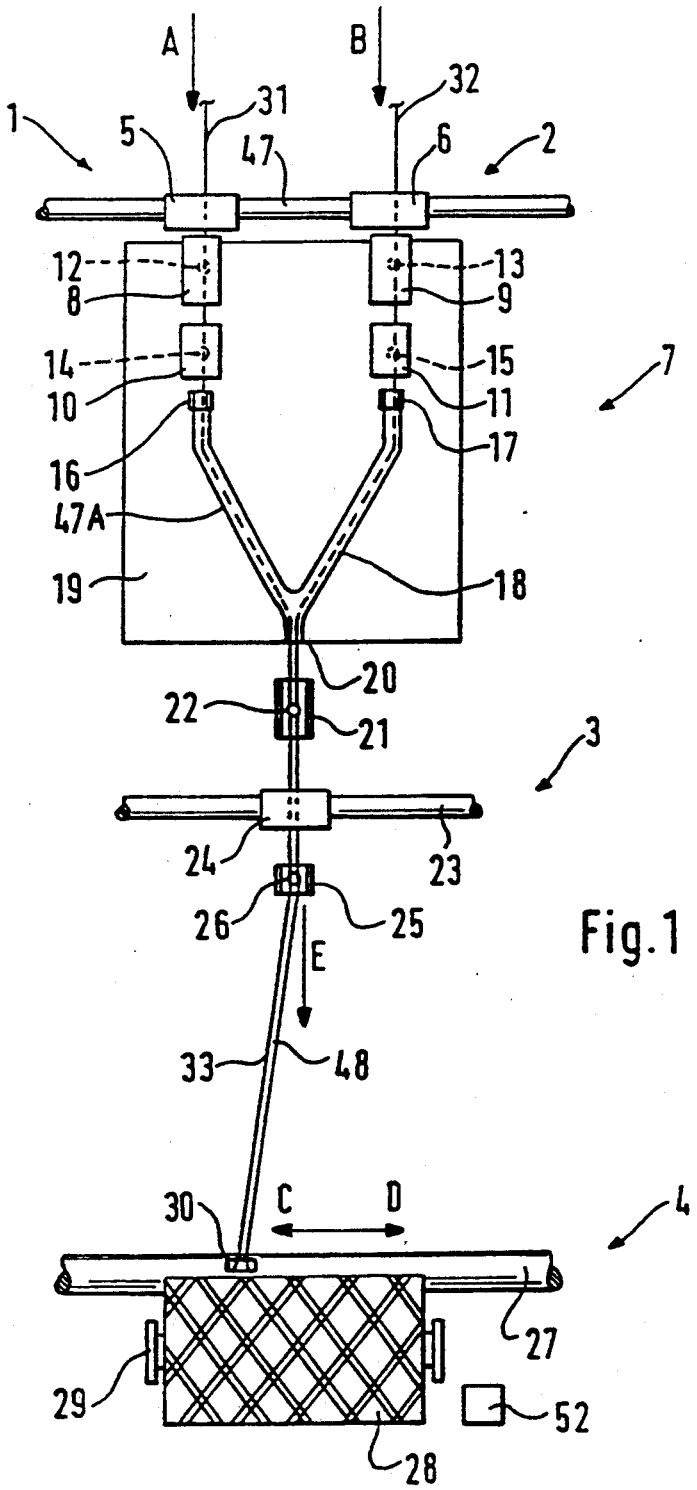
FIG. 1 is a schematic view of an individual spinning position of a spinning machine which produces X-packages onto which a double yarn is wound which is formed from two individual yarns, constructed according to a preferred embodiment of the invention.

Only a single spinning position is shown in FIG. 1. A spinning machine comprises a plurality of such spinning positions which are arranged in a row next to one another on one side of the machine.

Each spinning position comprises two drafting units 1, 2, behind which a false-twisting device 7, a withdrawal device 3 and a wind-up device 4 are arranged which wind the double yarn formed from two individual yarn components 33, 48 onto an X-package 28.

Of the drafting units 1, 2, which are constructed as multicylinder drafting units, only the respective pairs of delivery rollers are illustrated. They comprise a drivable bottom cylinder 47 which extends through in the longitudinal direction of the machine and to which pressure rollers 5, 6 are assigned. In the drafting units 1, 2, two slivers 31, 32 which travel through the drafting units 1, 2 in the direction of the arrows (A and B) are drawn to the yarn size desired for the individual yarns 33, 48.

The drawn slivers travel into the false-twisting device 7 which, for each of these slivers 31, 32, first has an intake nozzle 8, 9 and then a false-twisting nozzle 10, 11 which follows this intake nozzle. The intake nozzles 8, 9 are connected to compressed-air supply lines 12, 13, and the false-twisting nozzles 10, 11 are connected to compressed-air supply lines 14, 15. The false-twisting nozzles 10, 11 are followed by yarn detectors 16, 17, yarn guiding ducts 18, 47A of a housing 19 being connected to the yarn detectors 16, 17. Inside the yarn guiding ducts 18, 47A, the now spun individual yarns 33, 48 are guided together so that together they leave the mouth 20 of the two yarn ducts 18, 47A which approach one another in a V-shape.

The yarn components 33, 48 which are disposed next to one another are withdrawn by a common withdrawal device 3. This withdrawal device 3 is formed by a drivable cylinder 23 extending through in the longitudinal direction of the machine and of a pressure roller 24. The yarn components 33, 48 which are disposed next to one another travel to the wind-up device 4 in the direction of the arrow (E). A cross-winding device 30 which can be moved back and forth in the direction of the double arrow (CD) is assigned to the wind-up device 4, this cross-winding device 30 placing the double yarn, which is formed by the two yarn components 33, 48, in such a manner that an X-package 28 is wound. The X-package 28 comprises a spool tube which is supported by a spool frame or cradle 29. The cradle 29 is pivotable around an axis which is parallel to the axis of the X-package 28 and is provided with a load which presses the circumference of the X-package 28 against a drivable wind-up roller 27 which extends through in the longitudinal direction of the machine.

A swirling nozzle 21 is arranged between the false-twisting device 7 and the withdrawal device 3 and, by way of a switchable valve, which is not shown, is connected to a compressed-air supply line 22.

Behind the withdrawal device 3, a yarn holding device 25 is arranged which is formed by a suction nozzle which, with the insertion of a switchable valve, by way of a vacuum line 26, is connected to a vacuum source.

Figure 2:
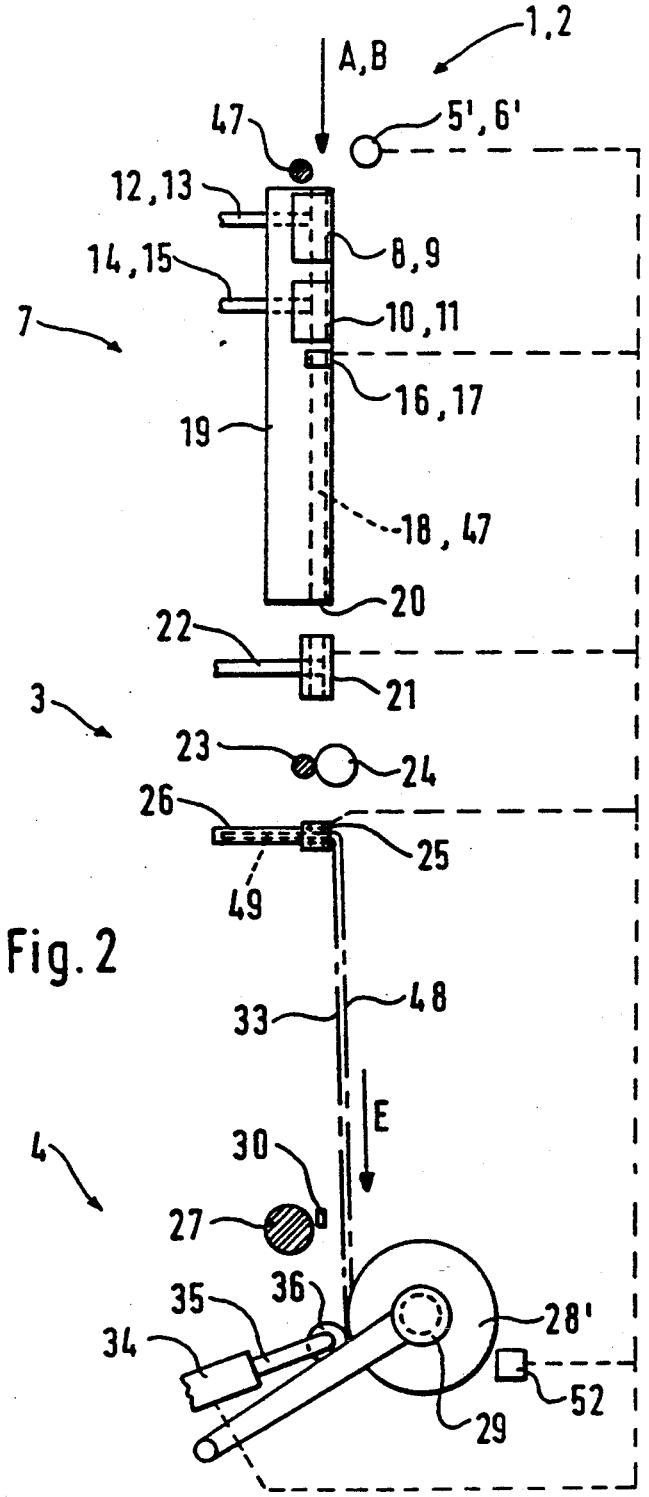
FIG. 2 is a lateral view of the spinning position according to FIG. 1, shown after a predetermined degree of fullness of the X-package is reached and after the spinning operation was interrupted.

A detector 52 which is connected to the spinning position control is assigned to the X-package 28. This detector 52 is set to a preselected degree of fullness of the X-package 28, after the reaching of which the spinning operation at the spinning position is interrupted according to a predetermined program. As indicated in FIG. 2 by interrupted lines, the spinning position control is connected in the manner explained in the following with the elements that can be switched on and off. The spinning position control controls a pneumatic or hydraulic cylinder 34 present at each spinning position, the piston 35 of this cylinder being directed by means of a lift-off roller 36 to the X-package 28 and, when it is actuated, swivelling this X-package together with the spool frame into the position 28' shown in FIG. 2. The lift-off roller 36 is constructed as a braking or driving roller so that the lifted-off X-package 28' comes to a stop with a controlled delay. Together with the lifting-off of the X-package 28', the swirling nozzle 21 is at the same time actuated by the opening of the corresponding valve so that the two yarn components 33, 48 are strengthened and connected with one another. Likewise, the yarn holding device 25 is actuated in that its pertaining valve is opened. The yarn components 33, 48 which at first continue to be produced are then sucked into the yarn holding device, as indicated by 49. Subsequently, after a predetermined delay, the operation of the drafting units 1, 2 is interrupted in that, for example, the pressure rollers 5, 6 which normally are arranged in a common load carrier are lifted off the bottom cylinders 47. As a result, the yarn components will break which continue to be withdrawn by the withdrawal device as long as they are still present. These ends are then sucked into the yarn holding device 25. The end of the double yarn formed by the yarn components 33, 48 is thus not wound onto the X-package 28'. By the lifting of the X-package 28' off the winding roller 27, the double yarn was also lifted out of the cross-winding device 30. The spinning position is now in a condition in which the package spool exchange or doffing is carried out in the manner which will be described in the following. It should also be mentioned that the yarn detectors 16, 17 are connected to the spinning position control in a manner corresponding to that of the detector 52 and trigger the same operations. After the breakage of one of the yarn components 33 or 48 or of both yarn components 33, 48, the same operation is therefore triggered so that for a piecing operation, the double yarn is also fixed at a predetermined point by the yarn holding device 25.

For the doffing, a movable doffing arrangement 37 is applied (FIG. 3) to the corresponding spinning unit which is situated in the position according to FIG. 2.

This movable doffing arrangement 37, in a manner not shown in detail, is equipped with a running gear which can be moved on tracks extending along the machine and which, if necessary, is stopped in front of a spinning position, after which the doffing arrangement 37 is stopped in a predetermined position with respect to the spinning position. The indicating of the requirement and thus the calling of the movable doffing arrangement 37 to the corresponding spinning position may be initiated by way of the machine control or the spinning position control which gives a corresponding signal.

The doffing arrangement 37 is provided with an auxiliary driving roller 46 for the swivelled-away X-package 28' which is arranged on an arm 45 which can be swivelled around an axis 44 of the doffing arrangement 37. The auxiliary driving roller 46 is provided with a drive which can be driven in both rotating directions. The auxiliary driving roller 46 can therefore drive the package 28' in the wind-off direction and in the wind-up direction. The auxiliary driving roller 46 first drives the X-package 28' in the wind-off direction so that the previously wound up double yarn is wound off along a predetermined length. Normally, this length amounts to between 10 m and 20 m. The wound-off yarn length is picked up by the suction device of the yarn holding device 25. Then the doffing arrangement 37 applies the double yarn to a yarn guide 41 which is arranged on a piston 42 of a hydraulic or pneumatic cylinder 43. During the rewinding of the double yarn formed from the yarn components 33, 48 which subsequently is controlled by the auxiliary driving roller 46, the yarn guide 41 therefore holds this double yarn in a predetermined area which is preferably situated in the center of the X-package 28'. The double yarn is therefore wound up at a predetermined location in parallel layers and/or layers which are disposed above one another. After the desired yarn length of the double yarn is wound up, the double yarn is cut by means of a cutting device of the doffing arrangement 37 so that the double yarn is cut into precise lengths and the two ends of the yarn components 33, 48 are also situated at the same location. This cutting-off may take place, for example, by means of a scissors-type cutting device which is mounted on the yarn guide 41. The cut-off double yarn end will then still be wound completely onto the X-package 28' by auxiliary driving roller 46.

During the winding-off and winding of the double yarn back onto the X-package 28', it is provided in a modified embodiment that the lift-off roller 36 has already been withdrawn so that it will not interfere with the winding-on. This is possible when a detent is provided for the holder 29 which locks it in the swivelled-away position. In the case of another embodiment, it is provided that the holder 29 is held in the swivelled-away position by a device of the doffing arrangement 37. For this purpose, an articulated arm 60 which has two fork-type holding devices 61 and can be swivelled around a stationary axis of the doffing arrangement 37 is applied to the spool tube on both sides of the spool body of the X-package 28'. The articulated arm is also subsequently used for the transfer of the finished X-package 28' to a conveyor belt 62 extending along the spinning machine below the spinning positions. The doffing arrangement 37 is also equipped with devices by which the holder 29 is moved apart by the swivelling of its arms in the axial direction of the spool tube and is therefore opened for the release of the X-package 28'.

After the removal and the transfer of the full X-package 28', an empty tube 56 is inserted into the holder 29. For this purpose, the doffing arrangement 37 is provided with an articulated arm 57 which can be swivelled around an axis 58 and which takes over a tube 56 from a magazine 55 of the doffing arrangement 37. Subsequently, the holder 29 is swivelled back into its working position so that the inserted package spool tube 56 comes to rest against the wind-up roller 27. Then the piecing is carried out during which the yarn obtained during the piecing is placed on the tube. This may take place, for example, in the manner known from the German Patent Document DE-A 36 34 464 corresponding to U.S. Pat. No. 4,790,130.

In a modified not shown embodiment, it is provided that the doffing arrangement 37 is equipped with a yarn storage device constructed as a suction device which is applied to the double yarn formed of the two yarn components 33, 48 before the winding-off of the double yarn is carried out which precedes the actual doffing operation. This yarn storage device will then receive the wound-off yarn length and will subsequently supply it again to the X-package 28'. In this embodiment, it is expediently provided that in the area of the yarn storage device of the doffing arrangement 37, a cutting device or the like is provided by means of which the double yarn, before being finally wound back onto the X-package 28', is cut to the desired length.

Figure 3:
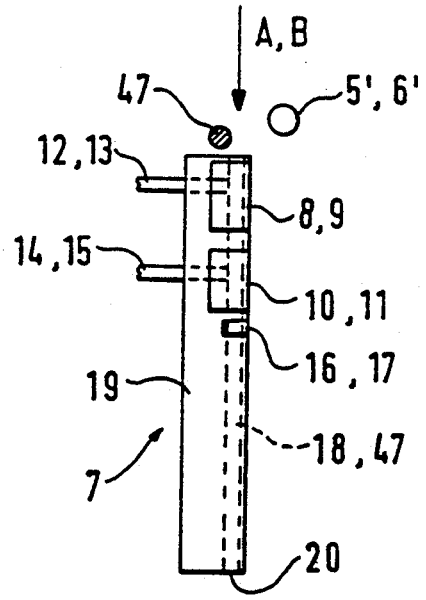
FIG. 3 is a view of the spinning position corresponding to FIG. 2 to which a doffing arrangement is applied that can be moved in the longitudinal direction of the machine.
Figure 3:
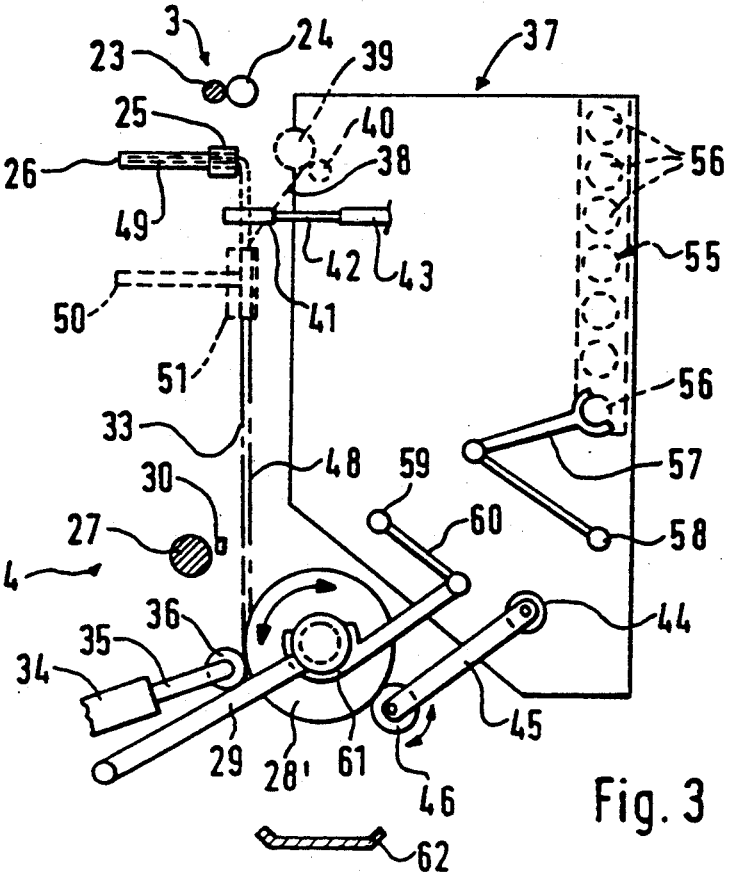

In the embodiment according to FIG. 3, it is also provided that a swirling nozzle 51 is arranged between the wind-up device 4 and the withdrawal device 3 which, by way of a switchable valve, is connected to a compressed-air line 50.

This swirling nozzle 51 will then be actuated by the opening of the pertaining valve by the doffing arrangement 37 when the previously wound-off double yarn is wound back on again. The yarn length that is wound up again will then be strengthened in comparison to the remaining double yarn so that it is more suitable for subsequent manipulations, for example, for being picked up and fed to a twisting machine. In a modified embodiment, it is provided that the swirling nozzle 51A (shown in dotted lines in FIG. 3) is a component of the doffing arrangement 37 and is applied by it to the double yarn between the yarn holding device 25 and the X-package 28'. In this case, it is advantageously provided that the swirling nozzle 51 has a threading slot or can be divided.

In a further modified embodiment, it is provided that the doffing arrangement 37 is equipped with an auxiliary yarn spool 39 to which a wind-off roller 40 is assigned. The yarn 38 of this auxiliary spool 39, by way of the yarn guide, is added to the double yarn wound-off before the actual doffing and is connected with it. The yarn of the auxiliary spool 39, in comparison to the double yarn, has a high strength so that then also a strengthened yarn end with a predetermined length is wound onto the X-package 28'. In a first embodiment, the auxiliary yarn 38 is a filament yarn which in the swirling nozzle 51 is connected with the previously wound-off double yarn and, after a predetermined yarn length is reached, is wound off together with the double yarn. In a further embodiment, it is provided that the doffing arrangement 37 is equipped with a splicer by means of which an auxiliary yarn 38 which has an increased strength is spliced to the double yarn. In this case, the double yarn is then expediently cut before the start of the winding-up so that subsequently only the auxiliary yarn 38 having a higher strength is wound onto the X-package 28' with a predetermined length and with a predetermined position.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A spinning machine comprising:

a plurality of spinning positions for producing yarn, each spinning position being equipped with means for spinning two single yarns and for guiding the single yarns together to form a double yarn and with X-package forming means for forming an X-package with the double yarn, doffing means including X-packing removing means for removing an X-package from a cradle of a spinning position and inserting means for inserting a tube in the cradle, package size detecting means for detecting a predetermined degree of fullness of an X-package, and spinning operation interrupting means for interrupting spinning operation at a spinning position in response to detection of a completed X-package by the package size detection means, wherein the doffing means includes winding off means for winding-off of yarn previously wound on an X-package, yarn strengthening means for strengthening and connecting the two ends of the wound off double yarn to form a double yarn end, and rewinding means for rewinding the strengthened double yarn end back onto a predetermined location on the X-package as the final windings on the X-package.

2. A spinning machine according to claim 1, wherein said doffing means is carried out at a movable servicing means which can be selectively moved between spinning positions for doffing operations.

3. A spinning machine according to claim 2, wherein each spinning position is equipped with yarn holding means for holding the yarn end created during the spinning operation interruption, the yarn holding means being arranged at a distance to the cradle for the X-package.

4. A spinning machine according to claim 3, wherein the yarn holding means comprise suction means.

5. A spinning machine according to claim 4, wherein the doffing means comprise means for taking over the yarn from the yarn holding means which are part of the spinning position.

6. A spinning machine according to claim 5, wherein the doffing means is equipped with cutting means for cutting the yarn into lengths which is to be wound up again onto the X-package.

7. A spinning machine according to claim 3, wherein the doffing means comprise means for taking over the yarn from the yarn holding means which are part of the spinning position.

8. A spinning machine according to claim 7, wherein each spinning position is equipped with cross-wind release means for taking the yarn out of a cross-winding means which is part of the spinning position, these cross-wind release means being operable during the interruption of the spinning operation when a predetermined degree of fullness of the X-package is reached.

9. A spinning machine according to claim 7, wherein each spinning position is equipped with package lifting means for lifting the X-package and its cradle off a wind-up means which can be operated when the predetermined degree of fullness of the X-package is reached.

10. A spinning machine according to claim 7, wherein the doffing means is equipped with cutting means for cutting the yarn into lengths which is to be wound up again onto the X-package.

11. A spinning machine according to claim 3, wherein the doffing means is equipped with cutting means for cutting the yarn into lengths which is to be wound up again onto the X-package.

12. A spinning machine according to claim 2, wherein each spinning position is equipped with cross-wind release means for taking the yarn out of a cross-winding means which is part of the spinning position, these cross-wind release means being operable during the interruption of the spinning operation when a predetermined degree of fullness of the X-package is reached.

13. A spinning machine according to claim 12, wherein each spinning position is equipped with package lifting means for lifting the X-package and its cradle off a wind-up means which can be operated when the predetermined degree of fullness of the X-package is reached.

14. A spinning machine according to claim 12, wherein the doffing means is equipped with cutting means for cutting the yarn into lengths which is to be wound up again onto the X-package.

15. A spinning machine according to claim 2, wherein each spinning position is equipped with package lifting means for lifting the X-package and its cradle off a wind-up means which can be operated when the predetermined degree of fullness of the X-package is reached.

16. A spinning machine according to claim 15, wherein the doffing means is equipped with cutting means for cutting the yarn into lengths which is to be wound up again onto the X-package.

17. A spinning machine according to claim 2, wherein the doffing means is equipped with cutting means for cutting the yarn into lengths which is to be wound up again onto the X-package.

18. A spinning machine according to claim 1, wherein the doffing means is equipped with cutting means for cutting the yarn into lengths which is to be wound up again onto the X-package.

19. A spinning machine according to claim 1, wherein said rewinding means includes means for rewinding the yarn in parallel layers on the X-package.

20. A spinning machine according to claim 19, wherein said rewinding means includes means for rewinding the yarn in layers disposed on top of each other on the X-package.

21. A spinning machine according to claim 1, wherein said rewinding means includes means for rewinding the yarn in layers disposed on top of each other on the X-package.

22. A spinning machine according to claim 21, wherein the doffing means is equipped with cutting means for cutting the yarn into lengths which is to be wound up again onto the X-package.

* * * * *